US005187816A

United States Patent [19]

Chiou

[11] Patent Number: 5,187,816

[45] Date of Patent: Feb. 23, 1993

[54] AUTOMATIC FLUSHING DEVICE

[75] Inventor: Tzeng-Shyang Chiou, Kaohsiung, Taiwan

[73] Assignee: Chen Chi Electro Chemical Co., Ltd., Kaohsiung, Taiwan

[21] Appl. No.: 795,015

[22] Filed: Nov. 20, 1991

[51] Int. Cl.[5] ..... E03D 5/10

[52] U.S. Cl. ..... 4/313; 4/304

[58] Field of Search ..... 4/302, 304, 305, 313

[56] References Cited

U.S. PATENT DOCUMENTS 4,707,867 11/1987 Kawabe et al. ..... 4/304 X
4,793,588 12/1988 Laverty ..... 4/305 X
4,989,277 2/1991 Tsutsui et al. ..... 4/415 X

FOREIGN PATENT DOCUMENTS 0450955 10/1991 European Pat. Off. ..... 4/302

*Primary Examiner*—Charles E. Phillips
*Attorney, Agent, or Firm*—Cushman, Darby & Cushman

[57] ABSTRACT

A water and energy efficient automatic flushing device is used to control water flow from a water inlet pipe to a flushing conduit of a plumbing fixture, such as a toilet bowl. The automatic flushing device includes an electromagnetic valve unit and a control unit to control opening and closing action of the electromagnetic valve unit. The control unit includes a programmed central processing unit (CPU), a transmitter circuit, a detecting unit to detect the presence of a person using the plumbing fixture, a receiver circuit and a valve control circuit. The valve control circuit opens the valve unit to initiate a first flushing action after confirming that the plumbing fixture is in use, and to initiate a second flushing action after verifying that the person using the plumbing fixture has departed. The receiver circuit can distinguish if a received signal was reflected by a person using the plumbing fixture or by a hand that was placed directly in front of the detecting unit. Upon confirmation that the received signal was reflected by a hand, the CPU actuates the valve control circuit so as to open the valve unit and initiate a hand activated flushing action. The valve unit is closed and flushing is terminated when the hand is removed from the detecting unit.

9 Claims, 11 Drawing Sheets

AUTOMATIC FLUSHING DEVICE

BACKGROUND OF THE INVENTION

1. Field of the Invention

The invention relates to an automatic flushing device, more particularly to a water and energy efficient automatic flushing device.

2. Description of the Related Art

Automatic flushing devices for controlling the flow of water to a plumbing fixture, such as a toilet bowl or urinal, are known in the art. One such type provides a first flushing action upon detection of a person using the plumbing fixture, thereby keeping the plumbing fixture clean and moist, and a second flushing action to wash away human waste. The disadvantages of conventional automatic flushing devices are as follows:

1. False operation of the flushing device often occurs. Electromagnetic interference (EMI), radio frequency interference (RFI) or even reflected light can cause untimely activation of the conventional flushing devices. This results in higher and less efficient water consumption.

2. Electrical consumption of the conventional flushing devices is relatively high since signal transmission continuously occurs.

3. When the elapsed time starting from the departure of a preceding user from the plumbing fixture up to the detection of a succeeding user using the plumbing fixture is relatively short, the first flushing action for the succeeding user is unnecessary since the second flushing action of the preceding user is sufficient to keep the plumbing fixture moist and clean. Unnecessary flushing of the plumbing fixture results in higher and less efficient water consumption.

SUMMARY OF THE INVENTION

Therefore, the objective of the present invention is to provide a water and energy efficient automatic flushing device which can overcome the above mentioned drawbacks commonly associated with the conventional automatic flushing devices.

Accordingly, the preferred embodiment of an automatic flushing device of the present invention is used to control the flow of water from a water inlet pipe to a flushing conduit of a plumbing fixture (such as a toilet bowl or a urinal) and comprises an electromagnetic valve unit connected to the water inlet pipe and to the flushing conduit, and a control unit to control the opening and closing action of the electromagnetic valve unit. The control unit includes: a programmed central processing unit; a transmitter circuit connected to and controlled by the central processing unit so as to transmit a set of coded electrical signals; a detecting unit to detect the presence of a person using the plumbing fixture, including a signal emitting unit (such as a light emitting device) connected to the transmitter circuit and generating a signal corresponding to the set of coded electrical signals, and a sensing unit (such as a photoelectric sensor) for generating a first electrical signal corresponding to a received signal reflected by the person using the plumbing fixture; a receiver circuit connected to the central processing unit and to the sensing unit so as to transmit the first electrical signal from the sensing unit to the central processing unit; and a valve control circuit connected to the central processing unit and to the electromagnetic valve unit, the valve control circuit being actuated by the central processing unit so as to open or close the electromagnetic valve unit.

The central processing unit actuates the valve control circuit so as to open the electromagnetic valve unit for a predetermined first time period when the first electrical signal from the sensing unit corresponds to the coded electrical signals transmitted by the transmitter circuit. The central processing unit further actuates the valve control circuit so as to open the electromagnetic valve unit for a predetermined second time period when generation of the first electrical signal is terminated, indicating that the person using the plumbing fixture has departed.

The sensing unit generates a second electrical signal corresponding to a received signal reflected by a hand placed directly in front of the detecting unit. The receiver circuit can distinguish if a received electrical signal from the sensing unit is the first electrical signal or the second electrical signal. The central processing unit then actuates the valve control circuit so as to open the electromagnetic valve unit upon reception of the second electrical signal and to close the electromagnetic valve unit when reception of the second electrical signal is terminated, indicating that the hand that was placed directly in front of the detecting unit has been removed.

The control unit further includes a counter means connected to the central processing unit for counting an elapsed time starting from the departure of a preceding person from the plumbing fixture up to the detection of a succeeding person using the plumbing fixture. The central processing unit prevents opening of the electromagnetic valve unit for the predetermined first time period when the elapsed time is less than a predetermined third time period.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
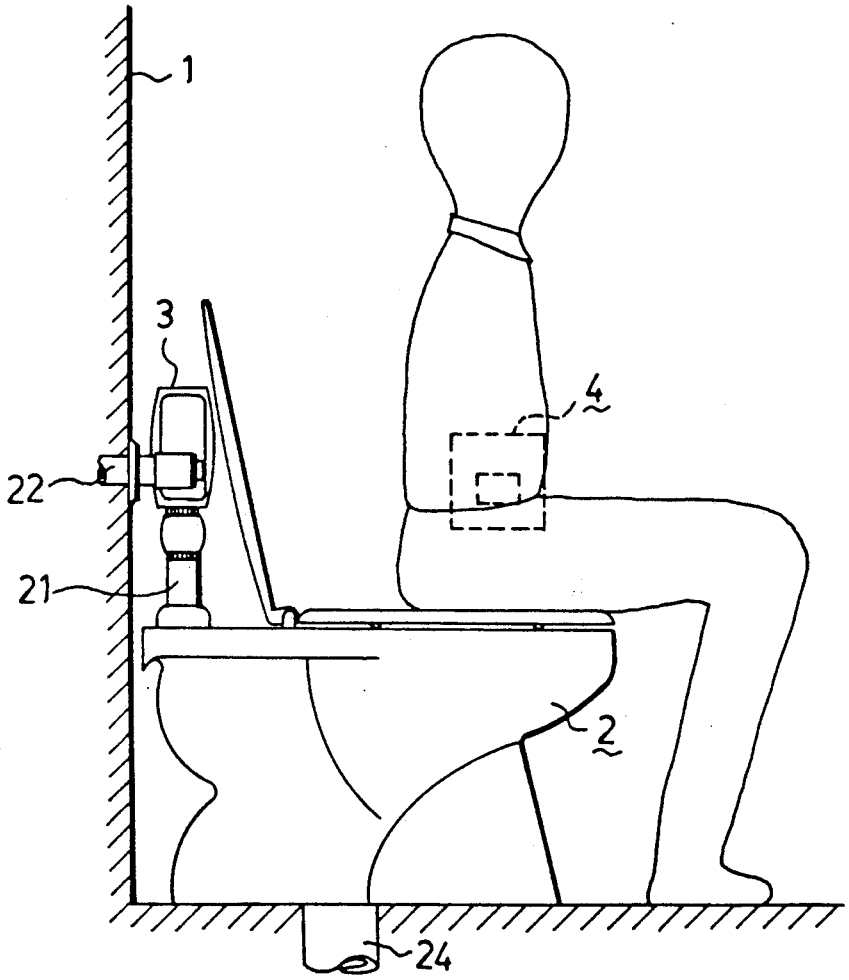
FIG. 1 is a side view of a toilet bowl incorporating the preferred embodiment of an automatic flushing device according to the present invention.

Referring to FIG. 1, the preferred embodiment of an automatic flushing device (3) according to the present invention joins a flushing conduit (21) of a plumbing fixture, such as a toilet bowl (2), and a water inlet pipe (22). A control unit (4) is embedded in a wall (1) adjacent to the toilet bowl (2) so as to detect the presence of a person using the toilet bowl (2). Water is supplied to the flushing conduit (21) after the person has departed the toilet bowl (2) so as to empty its contents via a discharge pipe (24).

Figure 2:
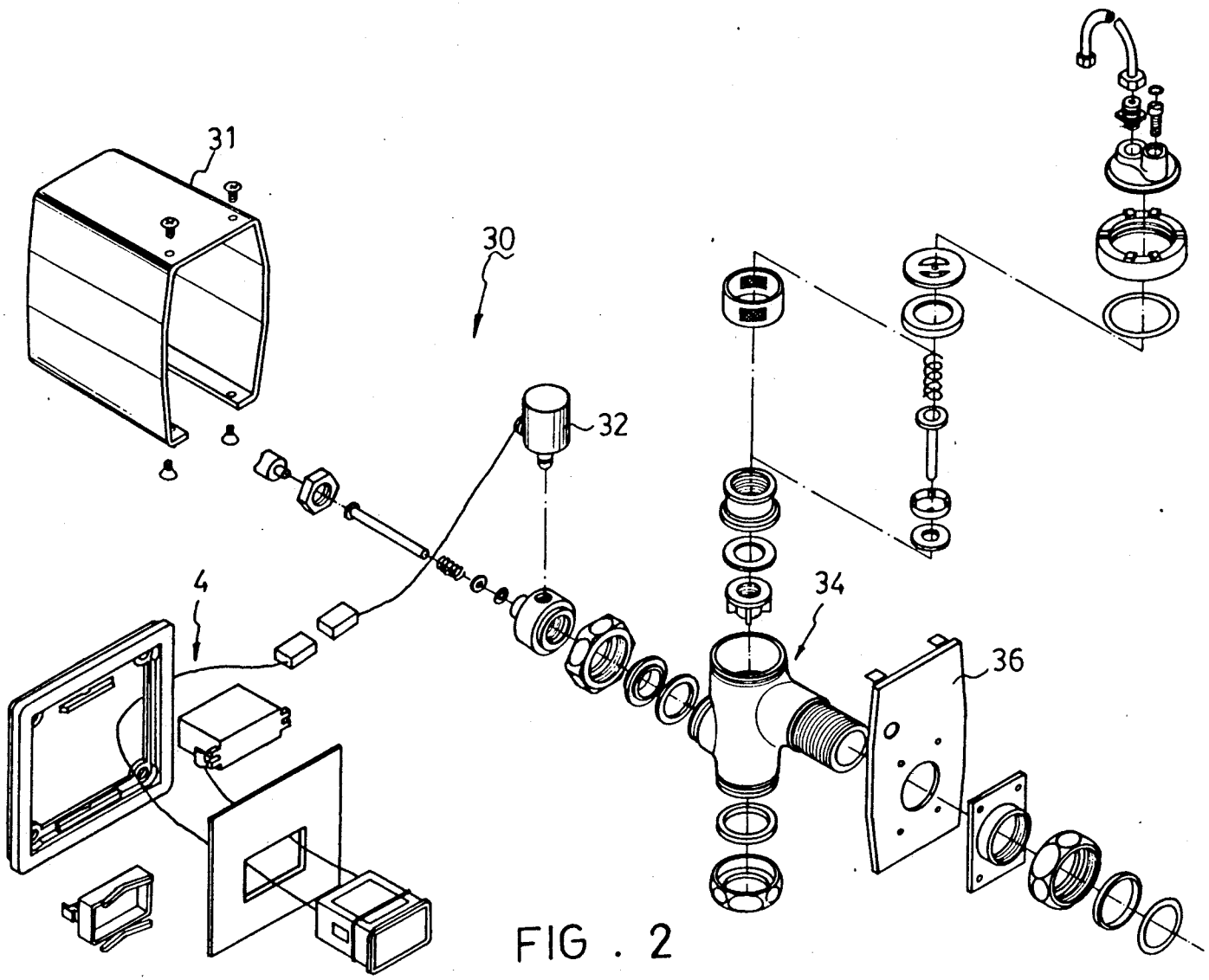
FIG. 2 is an exploded view of an electromagnetic valve unit of the automatic flushing device of the present invention.

Referring to FIG. 2, the preferred embodiment comprises an electromagnetic valve unit (30) including a valve housing (31), a solenoid valve unit (32), a piston valve unit (34) and a cover plate (36).

Figure 3:
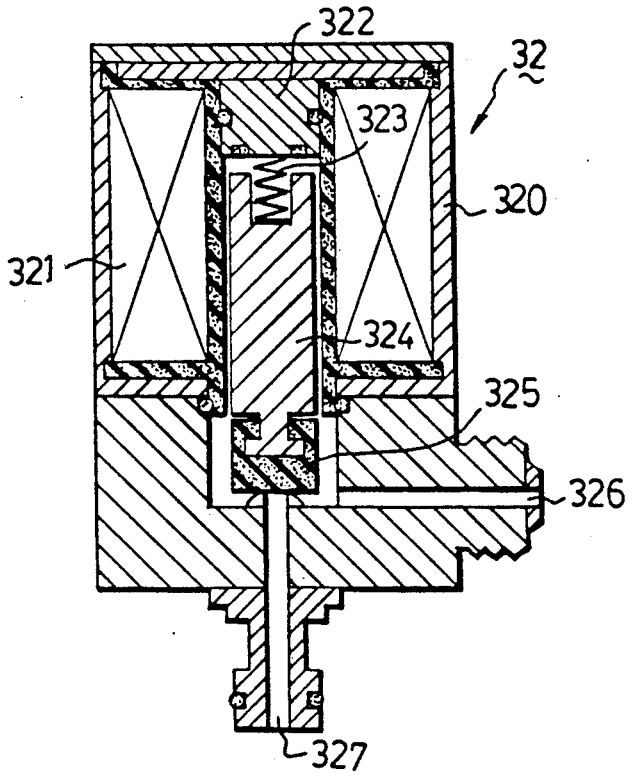
FIG. 3 is an illustration of a solenoid valve unit of the preferred embodiment when in a closed position.
Figure 4:
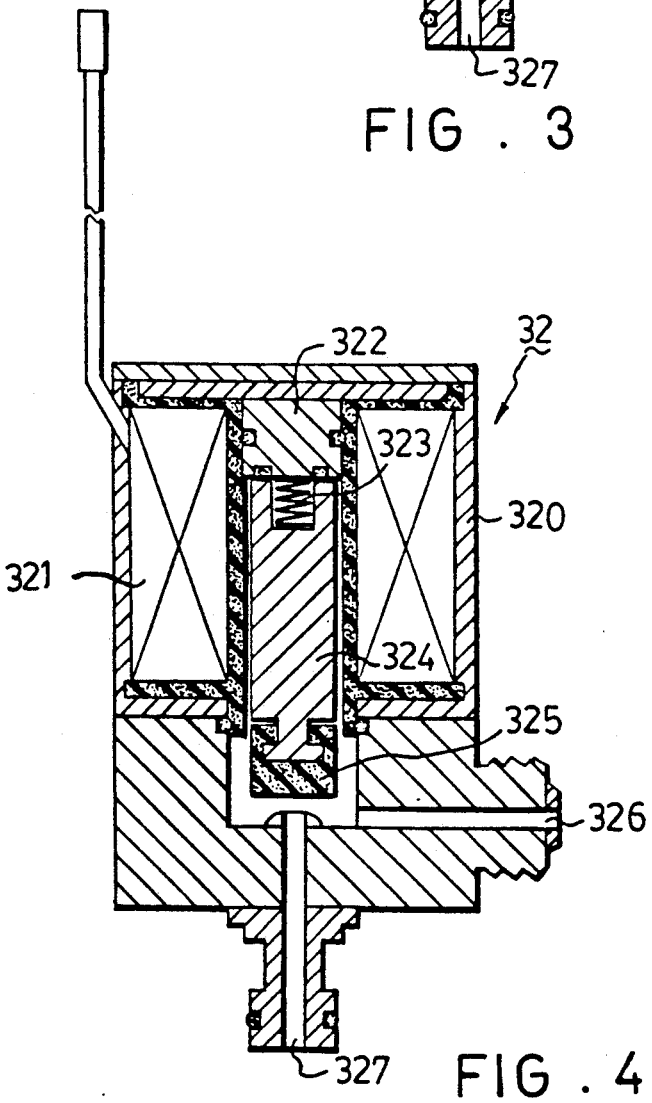
FIG. 4 is an illustration of the solenoid valve unit when in an open position.

Referring to FIGS. 3 and 4, the solenoid valve unit (32) comprises a valve casing (320), a solenoid provided inside the valve casing (320) and including a coil member (321) and an axial core member (324) disposed between a closed top end and a bottom fluid outlet (327) of the valve casing (320), a permanent magnet (322) attached to the closed top end of the valve casing (320), a spring member (323) to urge the core member (324) away from the permanent magnet (322) and a stopper (325) attached to the core member (324) to block the bottom fluid outlet (327).

When current is supplied to the coil member (321), the magnetic field induced by the coil member (321) moves the core member (324) against the action of the spring member (323). The permanent magnet (322) attracts the core member (324) to hold the stopper (325) in an open position away from a bottom fluid outlet (327), thus allowing water to flow from a fluid inlet (326) of the valve casing (320) and through the bottom fluid outlet (327).

Since there is a continuous force of attraction between the permanent magnet (322) and the core member (324), which force is sufficient to overcome the expanding force of the spring member (323), current supply to the coil member (321) can be stopped without causing any downward movement of the core member (324).

When it is desired to once more block the flow of water through the bottom fluid outlet (327), an oppositely polarized electric signal is supplied to the coil member (321) to generate a reverse magnetic field which pulls the core member (324) away from the permanent magnet (322), thereby placing the stopper (325) in a closed position to block the bottom fluid outlet (327).

From the foregoing discussion, current is supplied to the coil member (321) only when moving the core member (324) toward or away from the permanent magnet (322). It is therefore unnecessary to continuously supply current to the coil member (321) once the core member (324) is in contact with the permanent magnet (322). This illustrates the efficient energy consumption feature of the solenoid valve unit (32) of the preferred embodiment.

Figure 5A:
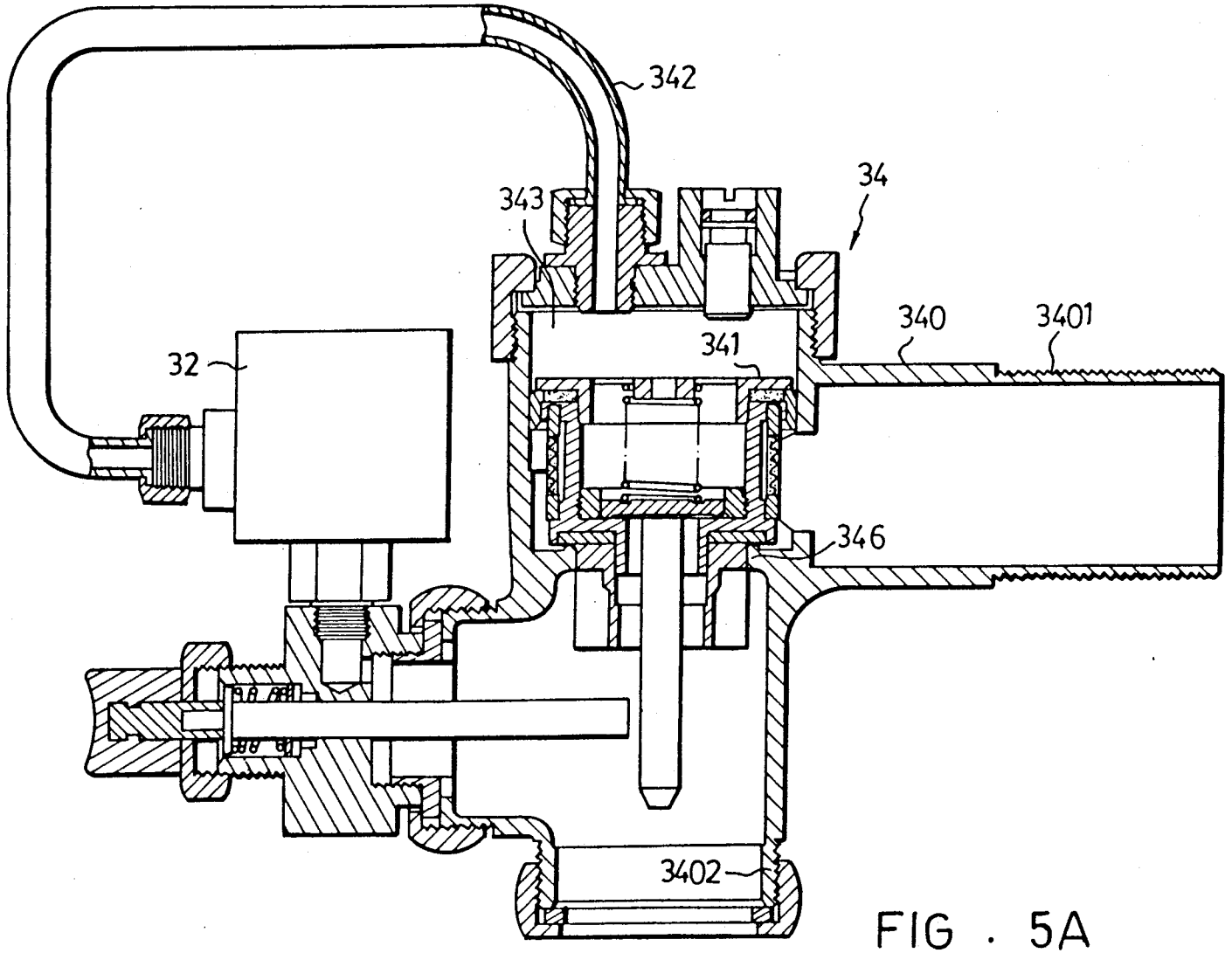
FIG. 5A is an illustration of the electromagnetic valve unit of the preferred embodiment when in a closed position.
Figure 5B:
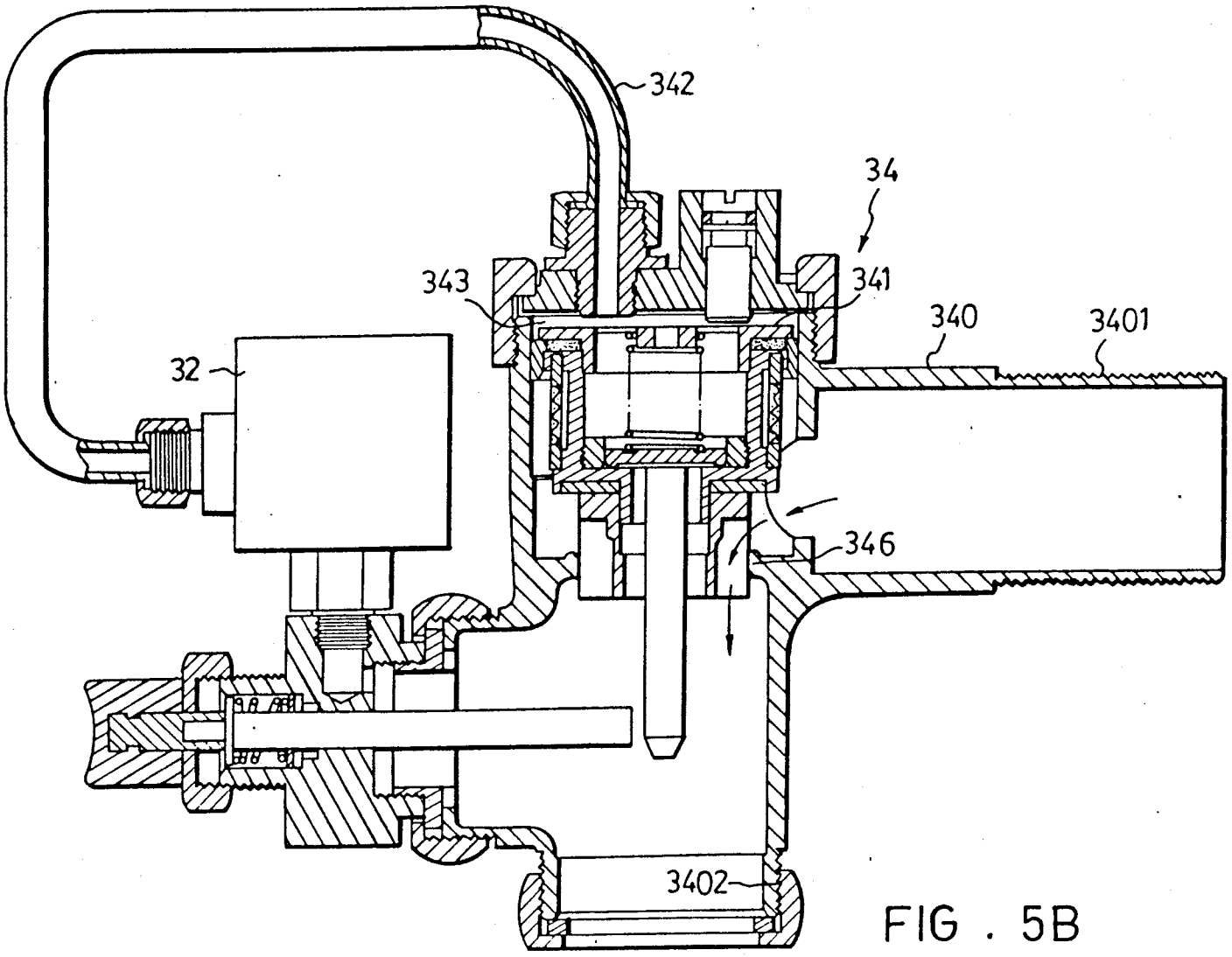
FIG. 5B is an illustration of the electromagnetic valve unit of the preferred embodiment when in an open position.

Referring to FIGS. 5A and 5B, the solenoid valve unit (32) actuates the piston valve unit (34) to permit water flow to the toilet bowl. A detailed description of the construction and operation of the piston valve unit (34) will not be provided herein since the piston valve unit (34) is known in the art and is not concerned with the main feature of the present invention.

The piston valve unit (34) has a valve housing (340) with an input end (3401) to be connected to the water inlet pipe (22) and an output end (3402) to be connected to the flushing conduit (21) of the toilet bowl (2) (Refer to FIG. 1). The piston valve unit (34) further has a plug member (341) movably provided inside the valve housing (340). When the solenoid valve unit (32) is activated to open the same, air and water trapped in a chamber (343) above the plug member (341) are released via a tube (342) which interconnects the valve housing (340) and the solenoid valve unit (32). The plug member (341) moves upward to unblock the valve seat (346), thereby permitting water to flow through the valve seat (346) and flush the toilet bowl (2).

When the solenoid valve unit (32) is activated to close the same, air and water cease to flow through the tube (342). Water accumulates in the chamber (343) and forces the plug member (341) to once more block the valve seat (346), thereby stopping water flow to the toilet bowl (2).

Figure 6:
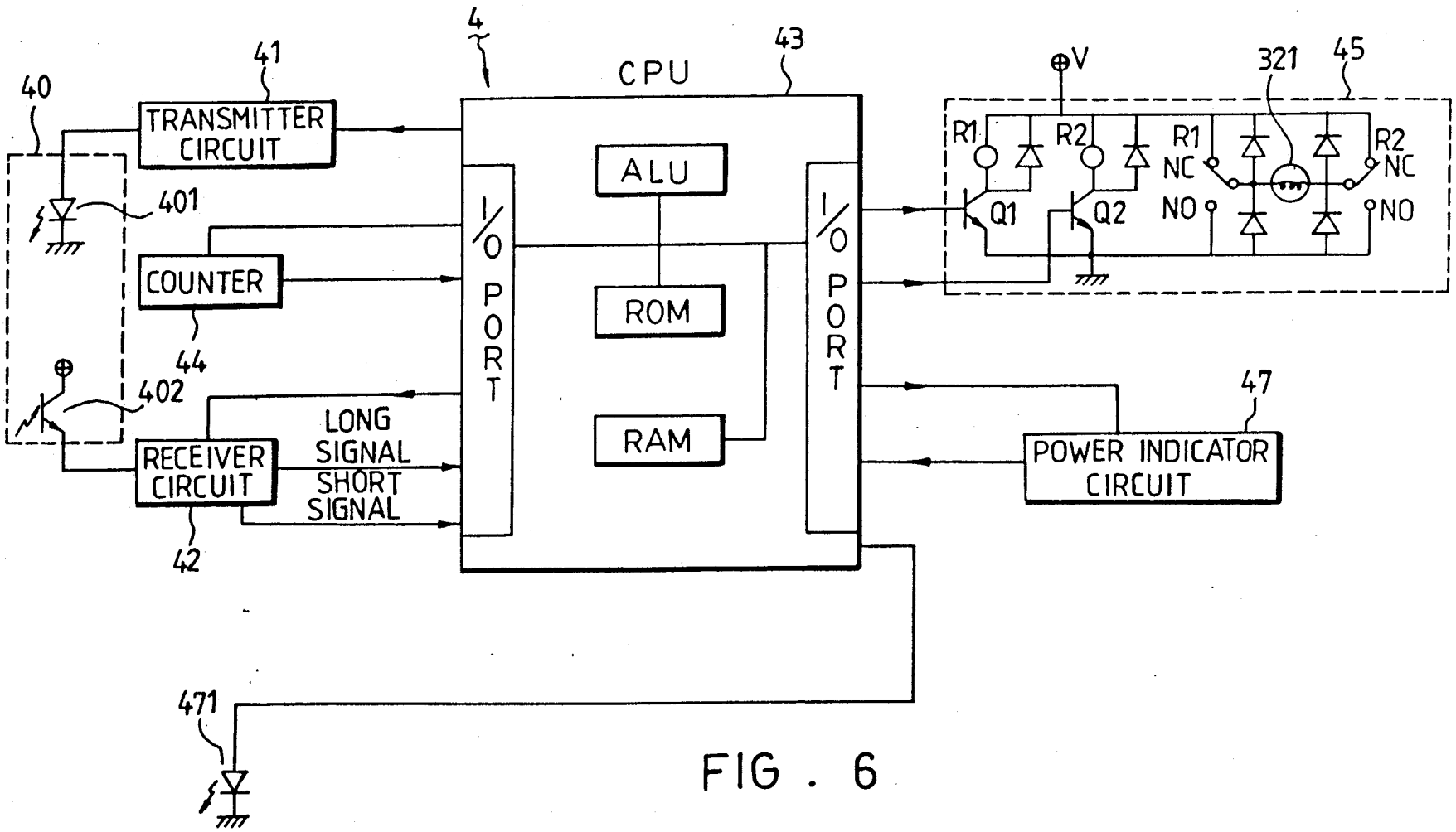
FIG. 6 is a schematic circuit block diagram of a control unit of the preferred embodiment of an automatic flushing device according to the present invention.

FIG. 6 is a schematic circuit diagram of the control unit (4) of the preferred embodiment. The control unit (4) comprises a detecting unit (40) that includes a light emitting unit (401) and a photoelectric sensing unit (402), a transmitter circuit (41), a receiver circuit (42), a central processing unit (43), a counter (44), a valve control circuit (45) and a power indicator circuit (47). A cell unit (V) supplies electric power to the control unit (4). The central processing unit (43) has an arithmetic logic unit (ALU), a read-only memory device (ROM), a random access memory device (RAM) and input/output (I/0) ports. A system operating software is stored beforehand in the read-only memory device (ROM).

Figure 7:
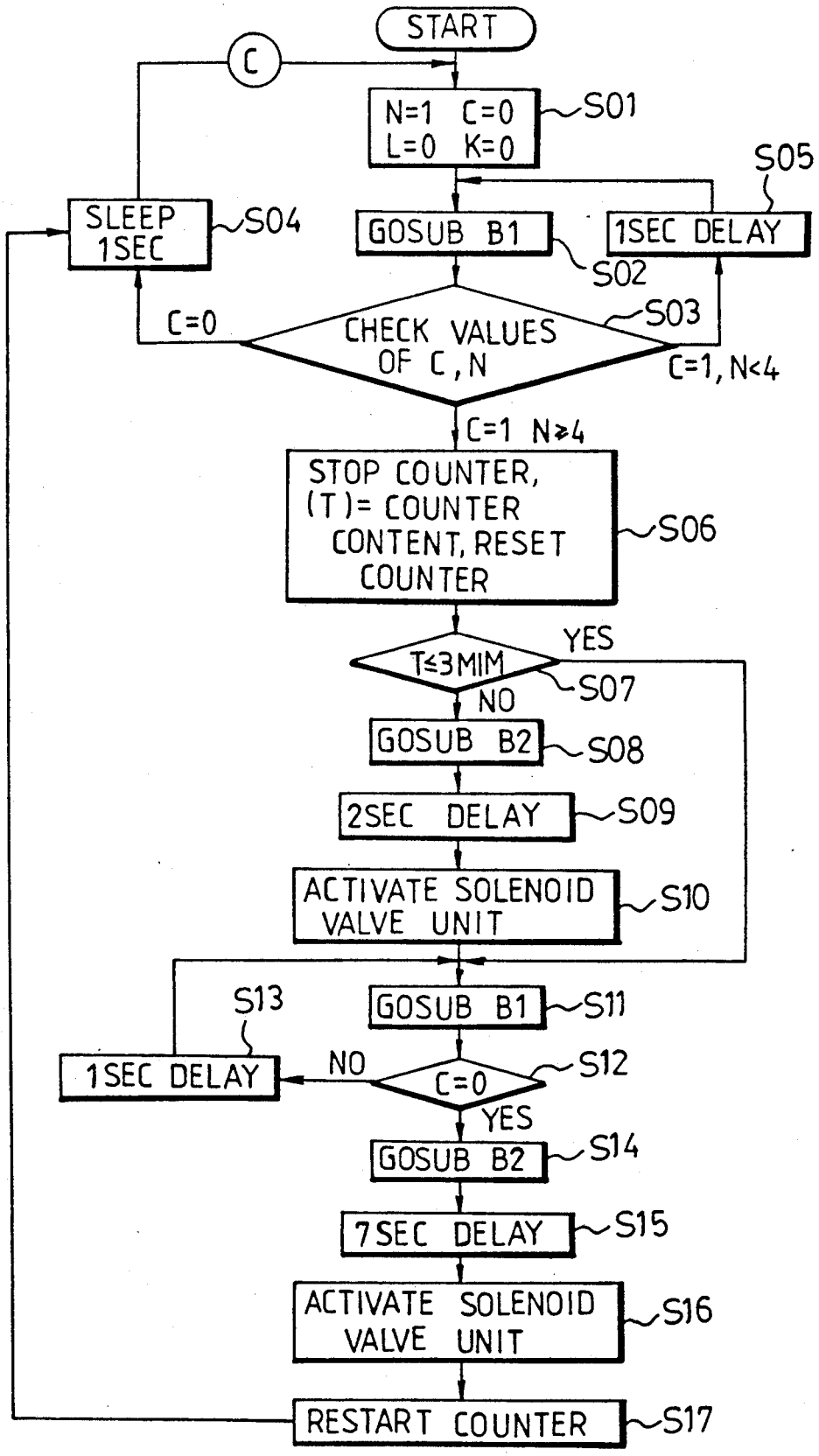
FIG. 7 is a flowchart of the main routine of a system operating software stored in a central processing unit of the control unit.

A flowchart of the main routine of the system operating software is shown in FIG. 7. A variable (N) is initially set to 1, while three other variables (C, L and K) are initially set to 0 [Instruction (SOl)]. A first subroutine (Bl) is then executed [Instruction (S02)].

Figure 8:
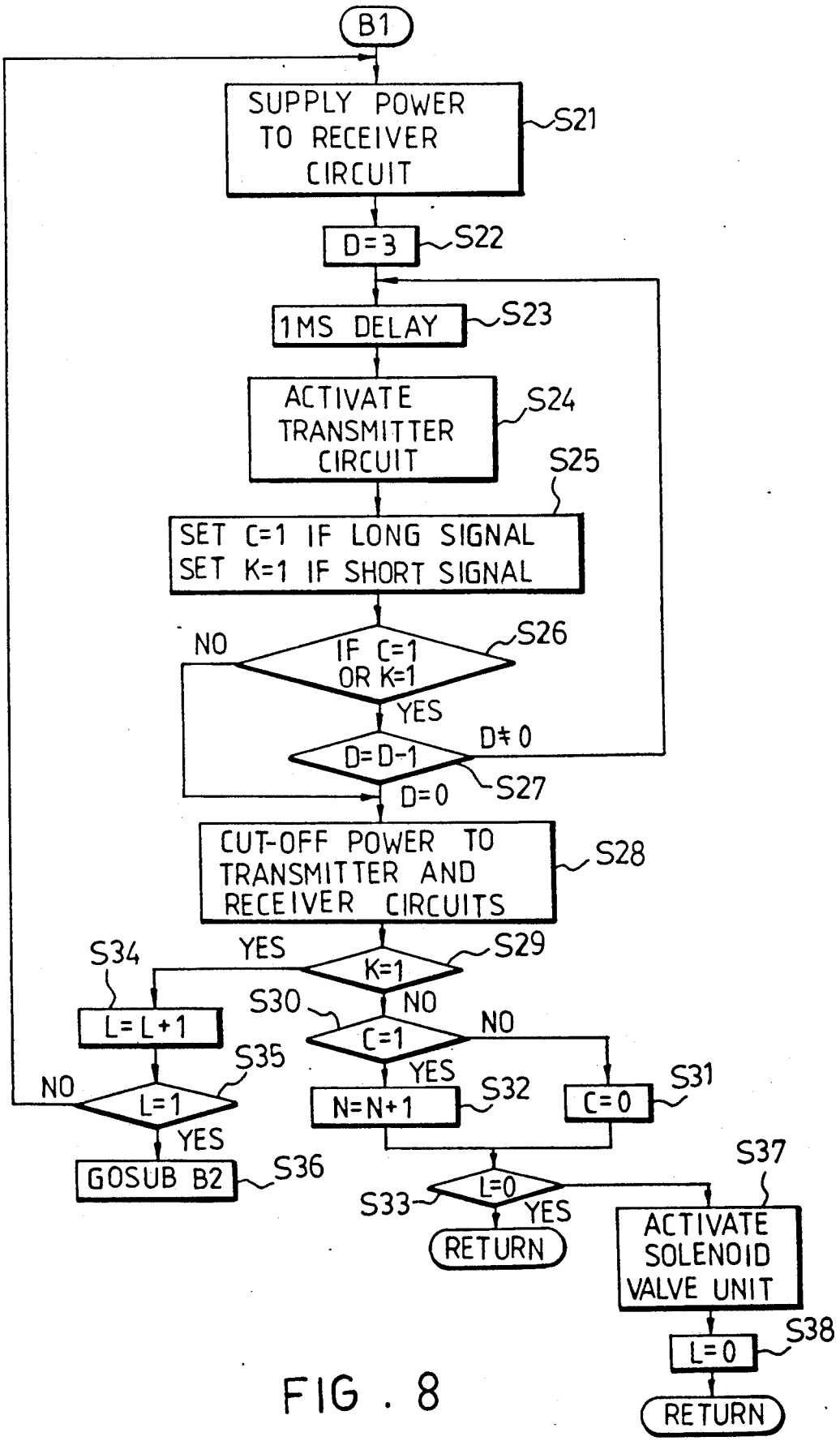
FIG. 8 is a flowchart of a signal transmission and reception subroutine of the system operating software.

A flowchart of the first subroutine (Bl) is shown in FIG. 8. Power is first supplied to the receiver circuit (42) [Instruction (S21)] and a variable (D) is set to 3 [Instruction (S22)]. A one millisecond delay is executed [Instruction (S23)] to allow the receiver circuit (42) to stabilize. The transmitter circuit (41) is then activated [Instruction (S24)] so as to actuate the light emitting unit (401) to generate a light signal to detect if the toilet bowl is in use. At the same time, the photoelectric sensing unit (402) generates an electrical signal to the receiver circuit (42), which electrical signal corresponds to the reflected light signals that are received by the same. The receiver circuit (42) can receive two types of electrical signals from the photoelectric sensing unit (402). The receiver circuit (42) receives a first electrical signal [hereinafter referred to as long signal (C)] from the photoelectric sensing unit (402) when the received light signal was reflected by a person using the toilet bowl (2). A second electrical signal [hereinafter referred to as short signal (K)] is received from the photoelectric sensing unit (402) when the received light signal was reflected by a hand that is placed directly in front of the detecting unit (40). The receiver circuit (42) can distinguish the two signals (C, K) according to the strength of the signal received. The long signal (C) is weaker since the round trip time (the time which elapsed starting from the transmission of a light signal up to its reception) is longer. The short signal (K) is stronger since the round trip time is shorter. The central processing unit (43) then sets one of the variables (C) or (K) to 1, depending upon the type of electrical signal received by the receiver circuit (42) [Instruction (S25)]. The variables (C, K) are then tested to determine if any one of the two variables was set to 1 [Instruction (S26)]. Power supply to the transmitter and receiver circuits (41, 42) is cut off if none of the variables (C, K) was set to 1 [Instruction (S28)]. If one of the variables (C, K) was set to 1, the variable (D) is reduced by 1 and is then tested to see if it is equal to 0 [Instruction (S27)]. A loop starting from Instruction (S23) is then executed as long as the variable (D) is not 0. Thus, the transmission of light signals continues even if a first transmitted light signal has been properly received. Power supply to the transmitter and receiver circuits (41, 42) is cut off [Instruction (S28)] when (D)=0, indicating that four transmitted light signals have been properly received by the photoelectric sensing unit (402). Cutting off the power supply to the transmitter and receiver circuits (41, 42) at this stage is done in order to conserve power consumption and does not affect the succeeding operations.

The variable (K) is then tested to determine if a short signal was received [Instruction (S29)]. If the variable (K) is not equal to 1, the variable (C) is then tested to check if a long signal was received [Instruction (S30)]. The toilet bowl is not in use if the variable (C) is not equal to 1. The variable (C) is reset to 0 [Instruction (S31)]. If (C)=1, the variable (N) is incremented by 1 [Instruction (S32)], and the variable (L) is tested to see if it is equal to 0 [Instruction (S33)].

Referring to FIGS. 7 and 8, an Instruction (S03) of the main routine is executed if (L)=0. The variable (C) is again tested when the Instruction (S03) is being executed. A one second sleep instruction is performed when (C)=0 [Instruction (S04)] before the main routine is again performed.

Figure 10:
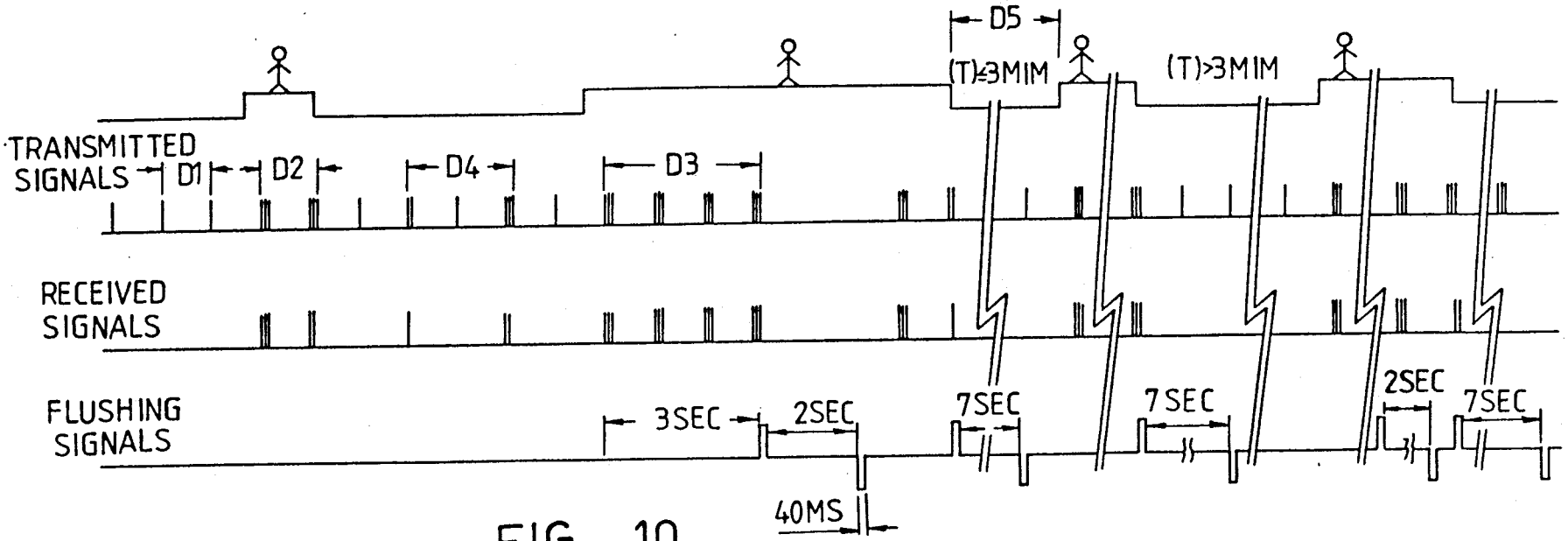
FIG. 10 is a timing diagram illustrating the relationship between the transmitted signals, the received signals and the resulting flushing actions when the preferred embodiment is in an automatic flushing mode.

The preceding paragraph describes the operation of the preferred embodiment when the photoelectric sensing unit (402) is not able to receive any reflected light signal, indicating that the toilet bowl (2) is not in use. Referring to FIG. 10, the interval (D1) illustrates the resulting signal diagram when the toilet bowl (2) is not in use. The time between two successive transmitted light signals is approximately one second.

Referring again to FIG. 7, the variable (N) is also tested when the Instruction (S03) is executed. An (N)<4 and (C)=1 condition indicates that a reflected light signal has been received. The next procedure would be to determine whether or not the received light signal is an accurate signal [caused by someone using the toilet bowl (2)].

When an (N)<4 and (C)=1 condition is detected, a one-second delay is completed [Instruction (S05)] before the first subroutine (B1) is again performed, thereby executing another signal transmission and reception action. Referring again to FIG. 10, when someone is in the operating area of the detecting unit (40) for an interval (D2) of less than three seconds, the variable (N) does not become equal to four and is eventually reset to one. No flushing action occurs. Untimely flushing of the toilet bowl (2) has thus been minimized.

Referring once more to FIGS. 6 and 7, an (N)≧4 and (C)=1 condition indicates that the toilet bowl (2) is in use [as shown at interval (D3) of FIG. 10]. The counting action of the counter (44) is stopped Instruction (S06)]. The contents of the counter (44) are then stored in a register (T) (not shown) of the central processing unit (43). The counter (44) is then reset. The contents of the register (T) are then checked to see if it is less than or equal to three minutes [Instruction (S07)]. (T)≦3 minutes indicates that the interval between a preceding user and a succeeding user is less than three minutes. A second subroutine (B2) is executed if (T)>3 minutes [Instruction (S08)]. The first subroutine (Bl) is executed if (T)≦3 minutes [Instruction (SII)].

Figure 9:
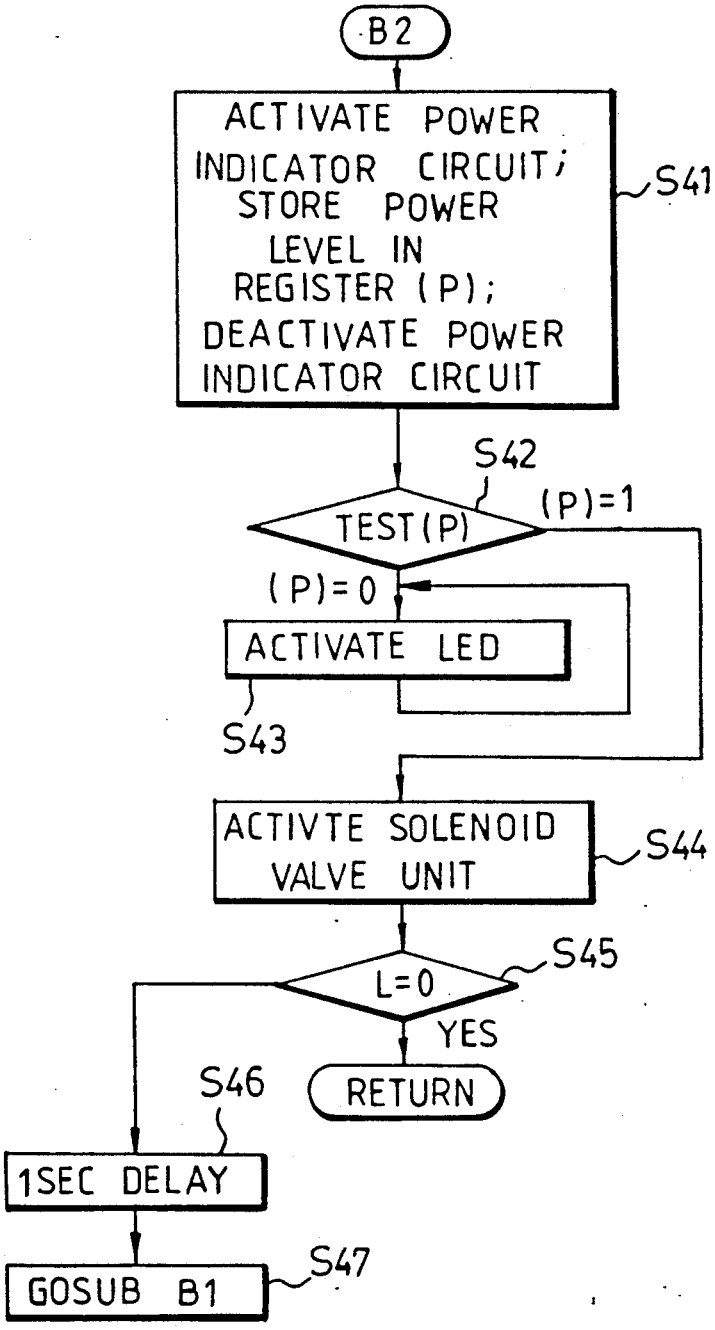
FIG. 9 is a flowchart of a valve opening subroutine of the system operating software.

A flowchart of the second subroutine (B2) is shown in FIG. 9. The power indicator circuit (47) is activated [Instruction (S41)] to check the remaining power level of the cell unit (V) (Refer to FIG. 6). A power indicator bit corresponding to the power level of the cell unit (V) is then stored in a register (P) (not shown) of the central processing unit (43), and the power indicator circuit (47) is deactivated. The contents of the register (P) is then checked to determine whether the remaining power of the cell unit (V) is sufficient [Instruction (S42)]. (P)=0 indicates that the remaining power of the cell unit is insufficient and a light emitting device (471) (such as an LED) is activated so as to indicate visually that the remaining power level of the cell unit (V) is insufficient and that replacement of the cell unit (V) is required [Instruction (S43)]. No other instruction is executed until replacement has been accomplished.

(P)=1 indicates that the remaining power level of the cell unit (V) is still sufficient. The solenoid valve unit (32) is activated for a period of forty milliseconds to open the same [Instruction (S44)]. Referring once more to FIG. 6, in order to open the solenoid valve unit (32), the central processing unit (43) actuates a transistor (Q1) of the valve control circuit (45) to conduct for a period of forty milliseconds. The movable contact arm of a first relay (R1) jumps from a normally closed contact (NC) to a normally open contact (NO). The normally open contact (NO) of the first relay (R1) and the normally closed contact (NC) of the second relay (R2) serve as a conductive path to permit current to flow through the coil member (321) of the solenoid valve unit (32). Referring once more to FIG. 4, the core member (324) moves upward to attract with the permanent magnet (322). After forty milliseconds, the solenoid valve unit (32) remains self-sustained in an open state, thereby opening the piston valve unit (34) to allow water to flow through the flushing conduit (21) to rinse the toilet bowl (2). Instruction (S09) of the main routine is then executed.

Referring once more to FIG. 7, after performing the second subroutine (B2), a two-second delay is executed [Instruction (S09)] to allow a two-second flushing action. The solenoid valve unit (32) is then activated to close the same [Instruction (S10)]. Referring to FIG. 6, in order to close the solenoid valve unit (32), the central processing unit (43) actuates a transistor (Q2) of the valve control circuit (45) to conduct for a period of forty milliseconds. The movable contact arm of the second relay (R2) jumps from the normally closed contact (NC) to the normally open contact (NO). The normally open contact (NO) of the second relay (R2) and the normally closed contact (NC) of the first relay (R1) serve as a conductive path to permit an oppositely directed current to flow through the coil member (321) of the solenoid valve unit (32). Referring once more to FIG. 3, the core member (324) is pulled away from the permanent magnet (322) to thereby close the solenoid valve unit (32). The piston valve unit (34) is correspondingly closed to prevent water from flowing through the flushing conduit (21). Referring again to FIG. 10, flushing of the toilet bowl (2) is initiated three seconds after confirming that the toilet bowl (2) is in use and is terminated two seconds later.

Referring again to FIG. 7, after the two-second flushing operation has been completed, the first subroutine (Bl) is once more executed to detect if the person using the toilet bowl (2) has departed [Instruction (S11)]. The variable (C) is then checked to see if it is equal to 0 [Instruction (S12)], indicating that the person using the toilet bowl (2) has departed. (C)=1 indicates that the toilet bowl is still in use and a one-second delay is executed [Instruction (S13)] before the first subroutine (Bl) is again performed [Instruction (S11)].

When (C)=0, the second subroutine (B2) is once more executed [Instruction (S14)]. The first relay (R1) is again energized so as to activate the solenoid valve unit (32) and accomplish a second flushing action. In the preferred embodiment, the duration of the second flushing action is set to seven seconds, so a seven-second delay is executed after performing the second subroutine (B2) [Instruction (S15)]. The solenoid valve unit (32) is then activated to close the same [Instruction (S16)] and counting action of the counter (44) is restarted [Instruction (S17)]. The Instruction (S04) is again performed before the main routine is again executed.

The first subroutine (Bl) is executed if the contents of the register (T) has been found to be less than three minutes during the execution of Instruction (S07), indicating that the interval between a prior user and a present user is less than three minutes. The first flushing action for the present user is not performed, thereby achieving the objective of reducing electric and water consumption.

FIG. 10 is a timing diagram of the preferred embodiment when in use. The light emitting unit (401) generates a light signal that corresponds to a set of coded electrical signals of the transmitter circuit (41). When the toilet bowl (2) is not in use [as shown in interval (D1)], a light signal corresponding to a first one of the coded electrical signals is transmitted and no reflected light signal is received by the photoelectric sensing unit (402). A light signal corresponding to a second one of the coded electrical signals is not transmitted because the preceding light signal was not received, thereby accurately detecting that the toilet bowl (2) is not in use.

When a person enters the operating range of the detecting unit (40) for a time period of less than three seconds [as indicated by the interval (D2)], the light signal corresponding to the first coded electrical signal will be properly received by the photoelectric sensing unit (402). However, the light signal corresponding to the second or third coded electrical signal will not be properly received by the photoelectric sensing unit (402). This indicates that the person has moved out of the operating range of the detecting unit (40). A passer-by status is detected, and thus, no flushing action will be initiated.

It is possible that extraneous light signals may be incorrectly received by the photoelectric sensing unit (402) and by the receiver circuit (42) as the reflected light signals [as shown in interval (D4)]. Thus, the transmitter circuit (41) may transmit the second or third coded transmitter signals at the wrong time. However, this condition rarely happens since the extraneous light signals seldom occur simultaneous with the operation of the transmitter and receiver circuits (41, 42). Thus, the extraneous light signals cannot be properly received as the reflected light signal corresponding to one of the coded transmitter signals. The received light signals can be tested to determine if they are extraneous light signals, thereby preventing the untimely transmission of the second or third coded electrical signals. The transmitter circuit (41) is then restored to transmitting the first one of the coded electrical signals.

In order to initiate a first flushing action, the variable (C) should be equal to 1 and the variable (N) should be greater than or equal to 4. This suggests that the toilet bowl (2) is in use, as shown in interval (D3). The receiver circuit (42) should have continuously and properly received four coded transmitted signals sent by the transmitter circuit (41). A two-second first flushing action is then executed after verifying that the toilet bowl (2) is in use. When the person using the toilet bowl (2) has departed [the variable (C) is reset to zero], a seven-second second flushing action is then executed to effectively flush the toilet bowl (2).

If the interval between a preceding user and a succeeding user is less than three minutes [as indicated by the interval (D5)], the first flushing action for the succeeding user is bypassed. Since the time between the second flushing action of the preceding user and the first flushing action of the succeeding user is relatively short, and since the effect of the first flushing action is to maintain the toilet bowl (2) in a moistened state, the second flushing action for the preceding user can replace the first flushing action for the succeeding user. A second flushing action is once more executed when the succeeding user has departed the toilet bowl. Thus, it is only when the elapsed time starting from the departure of a preceding user up to the detection of a succeeding user is less than three minutes that the first flushing action is bypassed. This results in reduced energy and water consumption.

Figure 11:
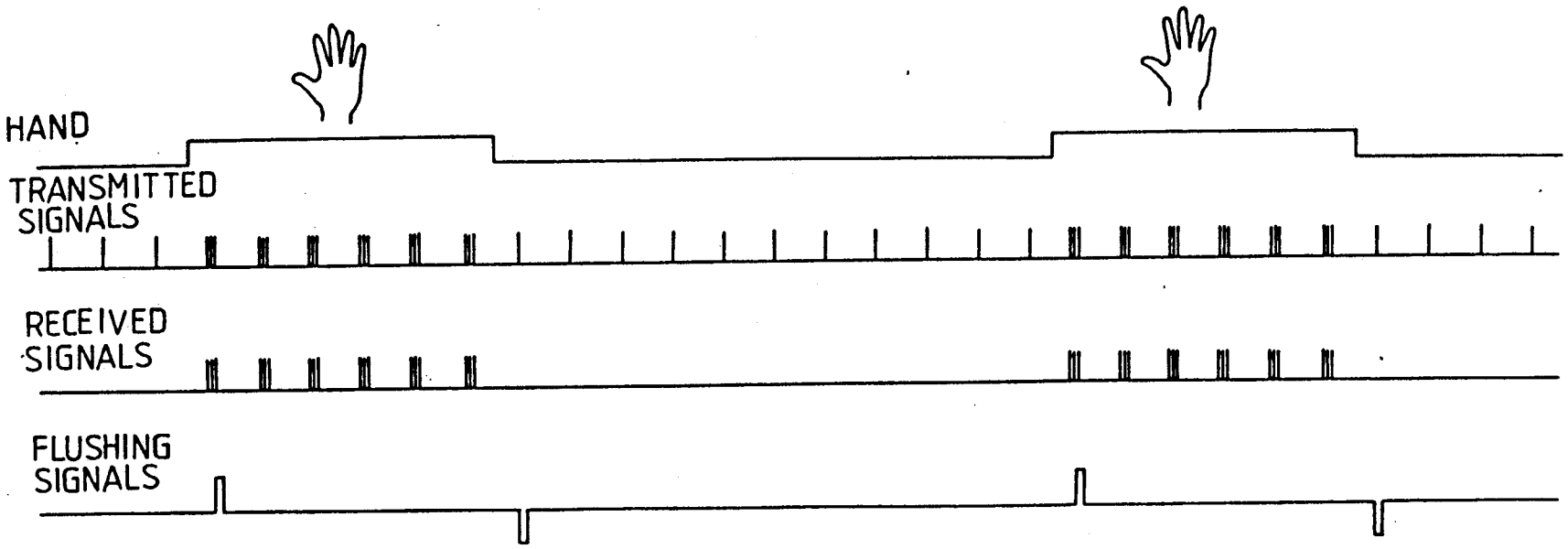
FIG. 11 is a timing diagram illustrating the relationship between the transmitted signals, the received signals and the resulting flushing actions when the preferred embodiment is in a hand activated flushing mode.

Referring to FIGS. 8 and 11, the variable (K) is set to 1 if the receiver circuit (42) receives a short signal which indicates that the received light signal was reflected by a hand that was placed directly in front of the detecting unit (40) [Instruction (S25)]. After verifying that (K)=1 [Instruction (S29)], the variable (L) is incremented by 1 [Instruction (S34)] and is tested to see if it is equal to 1 [Instruction (S35)]. The second subroutine (B2) is executed if (L) =1 to open the solenoid valve unit (32) and initiate a flushing action [Instruction (S36)]. Instruction (S21) is again executed if the variable (L) is not equal to 1.

Referring to FIG. 9, when executing the Instruction (S45) of the second subroutine (B2), the variable (L) is not equal to zero and thus, a one-second delay is performed [Instruction (S46)] before the first subroutine (Bl) is again executed Instruction (S47)].

Neither of the two signals (C, K) are received when the toilet bowl (2) is not in use and when the hand which was initially placed directly in front of the detecting unit (40) has been removed. Referring to FIGS. 8 and 11, the variable (L) is tested if it is equal to 0 when Instruction (S33) is being performed. Since the variable (L) has been set to a non-zero number beforehand [that is, when Instruction (S34) was executed], the solenoid valve unit (32) is activated so as to close the same and terminate the flushing action Instruction (S37)]. The variable (L) is reset to zero Instruction (S38)] before the Instruction (S03) of the main routine is again performed. This illustrates a hand activated mode of the present invention. Flushing can be initiated by placing a hand directly in front of the detecting unit (40). Flushing automatically stops when the hand is removed from the operating range of the detecting unit (40). Therefore, flushing action can be controlled by the user so as to ensure that human waste will be removed from the toilet bowl (2).

The advantages and distinguishing features of the present invention are as follows:

1. The transmitter circuit sends a group of coded electrical signals which must be properly received by the receiver circuit (period of transmission is about three seconds) so as to initiate a flushing action. No flushing action will be initiated because of a passerby or because of extraneous signals. This results in efficient use of both water and energy.

2. Power is supplied to the transmitter and receiver circuits only when transmission/reception is in progress. Power is cut off for a brief period (such as one second) after completion of a transmission-reception action. This results in reduced energy consumption.

3. If the interval between a preceding user and a succeeding user is less than three minutes, the two-second flushing action is not performed for the succeeding user. This is because the seven-second flushing action of the preceding user is sufficient to maintain the toilet bowl in a moistened state. This results in reduced energy and water consumption.

4. The present invention can be easily used in an automatic flushing mode or in a hand activated flushing mode.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. An automatic flushing device for controlling the flow of water from a water inlet pipe to a flushing conduit of a plumbing fixture, comprising:

an electromagnetic valve unit connected to said water inlet pipe and to said flushing conduit; and a control unit to control the opening and closing action of said electromagnetic valve unit, said control unit including: a programmed central processing unit; a transmitter circuit connected to and controlled by said central processing unit so as to transmit a set of coded electrical signals; a detecting unit to detect the presence of a person using said plumbing fixture, including a signal emitting unit connected to said transmitter circuit and generating a signal corresponding to said set of coded electrical signals, and a sensing unit for generating a first electrical signal corresponding to a received signal reflected by the person using said plumbing fixture; a receiver circuit connected to said central processing unit and to said sensing unit so as to transmit said first electrical signal from said sensing unit to said central processing unit; and a valve control circuit connected to said central processing unit and to said electromagnetic valve unit, said valve control circuit being actuated by said central processing unit so as to open or close said electromagnetic valve unit;

said central processing unit including a first programmed means for actuating said valve control circuit so as to open said electromagnetic valve unit for a predetermined first time period when said first electrical signal from said sensing unit corresponds to said coded electrical signals transmitted by said transmitter circuit, and further including a second programmed means for actuating said valve control circuit so as to open said electromagnetic valve unit for a predetermined second time period when generation of said first electrical signal is terminated, indicating that the person using said plumbing fixture has departed;

said sensing unit generating a second electrical signal corresponding to a received signal reflected by a hand placed directly in front of said detecting unit; said receiver circuit being able to distinguish if a received electrical signal from said sensing unit is said first electrical signal or said second electrical signal, said central processing unit further including a third programmed means for actuating said valve control circuit so as to open said electromagnetic valve unit upon reception of said second electrical signal and to close said electromagnetic valve unit when reception of said second electrical signal is terminated, indicating that the hand that was placed directly in front of said detecting unit has been removed.

2. The automatic flushing device as claimed in claim 1, wherein said plumbing fixture is a toilet bowl.

3. The automatic flushing device as claimed in claim 1, wherein said central processing unit comprises a fourth programmed means for controlling said transmitter circuit to transmit a succeeding one of said coded electrical signals only after a preceding one of said coded electrical signals has been properly received by said central processing unit.

4. The automatic flushing device as claimed in claim 3, wherein said central processing unit further comprises a fifth programmed means for interrupting power supply to said transmitter circuit and to said receiver circuit for a predetermined third time period after proper reception of each of said coded electrical signals.

5. The automatic flushing device as claimed in claim 1, wherein said signal emitting unit is a light emitting device and said sensing unit is a photoelectric sensor.

6. The automatic flushing device as claimed in claim 1, wherein:

said control unit further comprises a counter means connected to said central processing unit for counting an elapsed time starting from the departure of a preceding person from said plumbing fixture up to the detection of a succeeding person using said plumbing fixture; and said central processing unit further comprises a fourth programmed means for bypassing said first programmed means so as to prevent opening of said electromagnetic valve unit for the predetermined first time period when the elapsed time is less than a predetermined third time period.

7. The automatic flushing device as claimed in claim 1, wherein said control unit further comprises a cell unit to supply electric power to said control unit and a power indicator unit to indicate the remaining power level of said cell unit.

8. The automatic flushing device as claimed in claim 1, wherein said electromagnetic valve unit comprises:

a piston valve unit having an input end connected to said water inlet pipe and an output end connected to said flushing conduit; and a solenoid valve unit actuated by said valve control circuit so as to open or close said piston valve unit and control water flow from said water inlet pipe to said flushing conduit.

9. The automatic flushing device as claimed in claim 8, wherein said solenoid valve unit comprises:

a valve casing having a closed top end, a fluid inlet and a bottom fluid outlet;

a solenoid disposed inside said valve casing and having a coil member connected to said valve control circuit and an axial core member, said axial core member being disposed between said closed top end and said bottom fluid outlet;

a stopper attached to said core member for blocking said bottom fluid outlet;

a permanent magnet attached to said closed top end above said core member; and a biasing means to urge said core member away from said permanent magnet;

whereby, when said valve control circuit is actuated to open said electromagnetic valve unit, said valve control circuit supplies current to said coil member so as to move said core member towards said permanent magnet; said permanent magnet attracting said core member to hold said stopper in an open position, thus making it unnecessary to continuously supply current to said coil member to open said electromagnetic valve unit.

* * * * *